United States Patent [19]

Chrichton et al.

[11] 4,302,990

[45] Dec. 1, 1981

[54] SOCKET WRENCH

[75] Inventors: John P. Chrichton, Avon; John M. Trebel, Simsbury; George W. Cuff, East Haddam; David H. Goodwin, Prospect, all of Conn.; Edward D. Levy, Franklin Lakes, N.J.

[73] Assignee: Litton Industrial Products, Inc., New Britain, Conn.

[21] Appl. No.: 91,500

[22] Filed: Nov. 5, 1979

[51] Int. Cl.[3] ..... B25B 13/46

[52] U.S. Cl. ..... 81/60; 81/177 M; 81/177 N; 145/62; 206/378

[58] Field of Search ..... 81/60, 62, 177 M, 177 G, 81/177 ST, 177.8, 177.9, 177 N, 121 B, 180 R, 58.1; 16/110.5; 206/378; 30/125; 145/62, 63; 220/20, 22

[56] References Cited

U.S. PATENT DOCUMENTS

| | | | |
|---|---|---|---|
| 151,315 | 5/1874 | Rowe | 81/58.1 |
| 794,952 | 7/1905 | Schroeder | 81/58.1 |
| 828,151 | 8/1906 | Upjohn | 220/20 |
| 1,381,889 | 6/1921 | Arnold . | |
| 1,416,461 | 5/1922 | Hauce . | |
| 1,784,203 | 12/1930 | Rice . | |
| 2,180,572 | 11/1939 | White . | |
| 2,413,082 | 12/1946 | Skaer | 7/167 |
| 2,707,784 | 5/1955 | Erdos . | |
| 3,004,270 | 10/1961 | Cowley . | |
| 3,006,395 | 10/1961 | Dye . | |
| 3,056,442 | 10/1962 | Wrigley . | |
| 3,114,401 | 12/1963 | Johnson . | |
| 3,127,799 | 4/1964 | Bergquist | 81/62 |
| 3,149,707 | 9/1964 | McInnis | 81/62 |
| 3,222,943 | 12/1965 | McDonald . | |
| 3,598,002 | 8/1971 | Garvey . | |
| 4,043,230 | 8/1977 | Scrivens . | |
| 4,253,356 | 3/1981 | Martinmaas | 81/177 N |

*Primary Examiner*—James L. Jones, Jr.
*Attorney, Agent, or Firm*—Brian L. Ribando

[57] ABSTRACT

A socket wrench comprises a ratchet head which is removably held in an aperture in the forward end of a ratchet handle. A knurled drive ring allows the ratchet head to be used when detached from the handle and the handle itself is hollow and receives a tray which is dimensioned to hold a plurality of sockets. Access to the sockets is obtained by withdrawing the tray from the handle.

8 Claims, 4 Drawing Figures

Fig_2
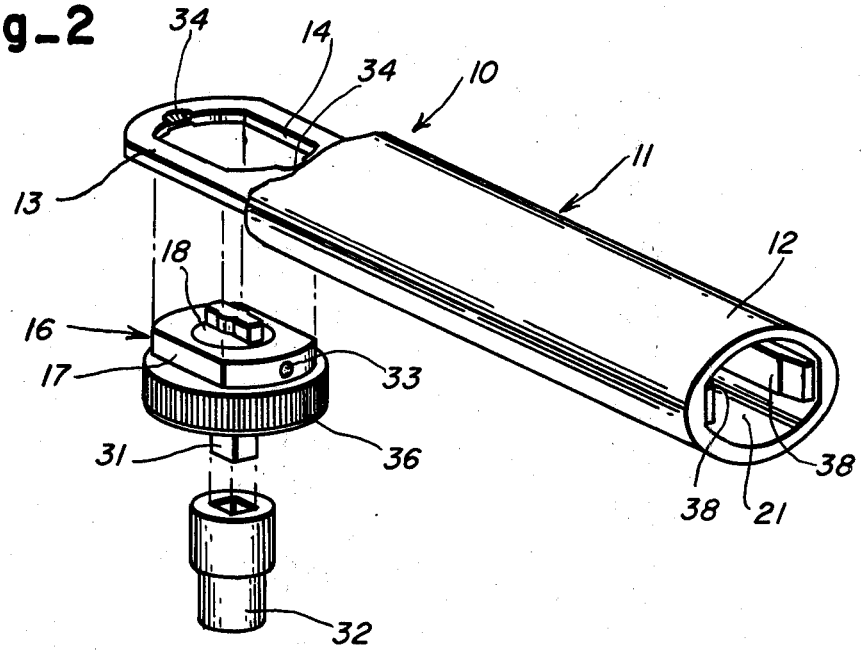
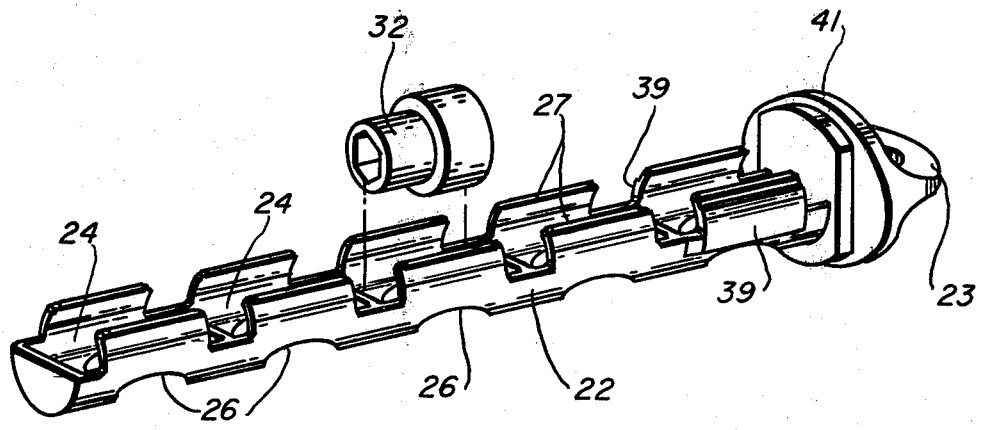
Fig_3

SOCKET WRENCH

BACKGROUND OF THE INVENTION

The invention relates to a socket wrench having a ratchet head which is removably fixed on a handle which contains a tray for holding a plurality of sockets.

Ratchet elements for use with nonratcheting tool handles are well known in the prior art. Such ratcheting elements are shown in the U.S. Patents to Bergquist, U.S. Pat. No. 3,127,799; McDonald, U.S. Pat. No. 3,222,943; McInnis, U.S. Pat. No. 3,149,707; and Wrigley, U.S. Pat. No. 3,056,442. In the known constructions, the ratchet element includes a driving stud on which a socket element may be secured, and an oppositely located aperture which receives the driving stud of a handle. Because of their constructions, such structures tend to be bulky. Furthermore, such ratchet elements are designed to be used only with a nonratcheting tool handle and are not adapted to be used either with a handle or without, as may be desired.

The prior art shows several forms of hand tools in which the tool handle is adapted to store the tool itself. Such arrangements are often used for screwdrivers of Allen-type wrench devices. Examples are shown in the U.S. Patents to Johnson, U.S. Pat. No. 3,114,401; Erdos, U.S. Pat. No. 2,707,784; Dye, U.S. Pat. No. 3,006,395; Garvey, U.S. Pat. No. 3,598,002; and Scrivens, U.S. Pat. No. 4,043,230. The prior art does not show a tool of the socket wrench type in which the wrench handle is able to receive and store a set of sockets. While such wrenches operate in conjunction with one of a set of sockets, the socket set itself and a socket tray are always items which are separate from the ratchet and the handle. Such arrangements often result in the loss of one or more of the elements of the complete set.

SUMMARY AND OBJECTS OF THE INVENTION

A socket wrench comprises a ratchet head which is removably held in an aperture in the forward frame portion of a ratchet handle. A projecting portion of the head fits within the aperture and a locking device holds the ratchet therein. When the ratchet head is removed from the frame, the ratcheting mechanism may be operated by means of a knurled drive ring located therein. The handle of the socket wrench is hollow and dimensioned to receive a tray which holds a plurality of sockets. Access to the sockets is provided by withdrawing the tray from the hollow handle and removing the sockets therefrom.

It is therefore an object of the invention to provide a wrench having a ratchet head removably secured in an aperture in the forward portion of the wrench handle.

It is another object of the invention to provide a socket wrench in which a socket tray is stored in a bore within the handle.

These and other objects of the invention will be apparent from a detailed description of the invention taken together with the accompanying drawing figures.

BRIEF DESCRIPTION OF THE DRAWING

FIG. 2 is an exploded view in perspective of a wrench having a detachable ratchet head.

FIG. 3 is a perspective view of a tray for holding a plurality of sockets.

DESCRIPTION OF THE PREFERRED EMBODIMENT

Figure 1:
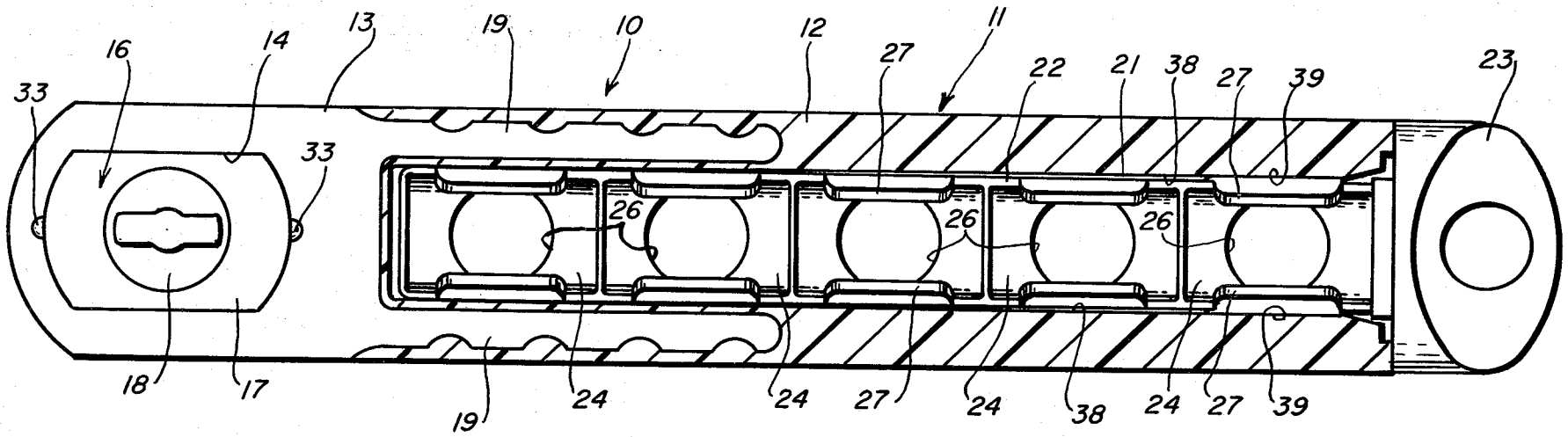
FIG. 1 is a perspective view partly in section of a wrench according to the invention.

Turning now to the drawings, there is shown in FIG. 1 a socket wrench generally designated by the reference numeral 10. The wrench is provided with a handle 11 which comprises a grip 12 and a frame 13. The frame 13 is apertured at 14 to receive a ratchet head generally designated 16. The ratchet head 16 comprises a relieved portion 17 which is dimensioned to fit within the aperture 14 and a cap 18 which allows reversal of the ratcheting drive mechanism. The frame 13 includes tangs 19 for secure attachment to the grip 12.

The handle 11 includes a bore 21 which slideably receives a tray 22 and a tab 23 is provided on one end of the tray 22 for withdrawing the same from the handle 11. It will be seen that the tray 22 comprises a plurality of compartments 24 each of which includes an aperture 26 in the floor thereof. Each compartment 24 is also provided with a pair of lips 27 which extend above the rim of each of the compartments 24 which act to retain a socket element (not shown) therein.

Turning now to FIG. 2, it will be seen that a drive stud 31 which is dimensioned to receive a socket 32 is centrally positioned on the lower side of the ratchet head 16. One or more detent means such as a ball 33 is positioned on the relieved portion 17 and engages a recess 34 or other means in the frame aperture 14 to maintain the ratchet head secure therein. A knurled drive ring 36 is provided on the outer periphery of the ratchet head 16 to allow the ratcheting mechanism to be used when the head has been removed from the handle 11. Two rails 38 guide the tray 22 into the bore 21 and engage the friction surfaces 39 on either side of the tray to secure the tray within the handle 11.

Figure 4:
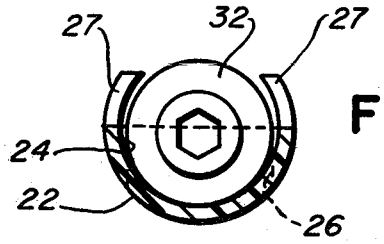
FIG. 4 is a sectional view of a socket tray with a socket positioned therein.

Turning now to FIGS. 3 and 4, it will be seen that each of the compartments 24 are dimensioned to receive a socket element 32. The lips 27 retain the socket within the compartments 24, and the aperture 26 allows a user's finger to push the socket 32 past the retaining lips 27 and out of the compartment when its use is desired. The tray 22 is provided with a head 41 at one end thereof which is complimentary in shape to the cross-section of the handle 11, and may advantageously be oval to prevent rolling of the tray when the same is placed on a flat surface.

The use of the device will be apparent to those skilled in the art. When a socket is needed for use with the wrench, the tray 22 may be removed from the handle 11 to allow the socket to be pushed out of its compartment 24 and placed on the drive stud 31. Where limited access prohibits ratcheting of the mechanism by means of the handle, the ratchet head 16 may be removed from the handle and the combination of the ratchet and a socket may be held by the knurled drive ring 36 and turned with the fingers in order to effect a wrenching action.

Having thus described the invention, various modifications and alterations will occur to those skilled in the art, which modifications and alterations are intended to be within the scope of the present invention as defined in the appended claims.

We claim:

1. In a socket wrench comprising a handle and a driving stud which is adapted to receive a selected one of a set of sockets, the combination comprising:

a grip and a frame comprising said handle, the driving stud being mounted on said frame, a bore formed along the length of the handle, an elongated tray dimensioned to hold a plurality of stud mating sockets and adapted for a sliding fit within the bore, a plurality of compartments formed in said tray, each compartment having an open top and being sized to receive an individual socket, lip means surmounting said open top for preventing accidential removal of a socket from said compartments, and friction means for releasably securing said elongated tray in said bore.

2. The socket wrench of claim 1 further comprising:

aperture means in the bottom of each of said compartments to facilitate ejection of a socket out of said compartments and past said lip means.

3. The socket wrench of claim 2 further comprising:

a head on one end of said tray, and tab means on said head for withdrawing said tray from said bore, said head being dimensioned to prevent said tray from rolling on a flat surface.

4. The socket wrench of claim 1 further comprising:

a ratchet head for controlling the driving stud, said driving stud being mounted one one side of said ratchet head, a knurled drive ring around the periphery of said ratchet head, a relieved portion on another side of said ratchet head and being shaped to be received in an aperture in said frame, and releasable means for locking said relieved portion in said aperture, said releasable means allowing said ratchet head to be removed from said handle and operated by means of said knurled drive ring.

5. A socket wrench comprising:

ratchet head means having a selectively dimensioned driving stud for matingly receiving any one of a selected set of sockets thereon, elongated handle means comprising a hollow grip being open at one end, means for securing said ratchet head means to one end of said handle means, and an elongated tray comprising a plurality of selectively dimensioned aligned compartments for storing individual sockets, said elongated tray being slidably insertable into the open end of said grip, lip means integrally formed in said handle tray at each compartment for releasably securing each socket of said selected set of sockets axially aligned with one another in said compartments, friction means for releasably securing said tray within said hollow grip, and frame means extending from said grip opposite said open end for securing said ratchet head means thereon.

6. A socket wrench according to claim 5 further comprising aperture means in each of said compartments to facilitate ejection of a socket out of said compartments and past said lip means.

7. A socket wrench according to claim 6 further comprising a head on one end of said tray, and tab means on said head for withdrawing said tray from said grip, said head being dimensioned to prevent said tray from rolling on a flat surface.

8. A socket wrench according to claim 5 wherein said handle means includes five of said socket storing compartments and wherein a set of five graduated-sized sockets comprise said selected set of sockets and are stored in said compartments.

* * * * *